United States Patent [19]

Hull et al.

[11] Patent Number: 5,054,783

[45] Date of Patent: Oct. 8, 1991

[54] BINGO CADDY

[76] Inventors: Harold L. Hull, 401 Canyon Way, Sp 43, Sparks, Nev. 89434; Mary K. Rodriquez, 955 Thoma St., Reno, Nev. 89502; Patricia H. Foster, 166220 Lonehill Dr., Morgan Hill, Calif. 95037

[21] Appl. No.: 657,467

[22] Filed: Feb. 19, 1991

[51] Int. Cl.[5] ..... A45C 11/36; A63F 9/00; B65D 85/20

[52] U.S. Cl. ..... 273/148 A; 273/309; 206/315.1; 248/461; 190/11; 190/900

[58] Field of Search ..... 273/309, 148 A, 269, 273/287; 206/315.1; 248/461, 452, 450; 190/11, 900

[56] References Cited

U.S. PATENT DOCUMENTS

| | | | |
|---|---|---|---|
| D. 272,923 | 3/1984 | Quinn et al. | D21/55 |
| 2,784,973 | 3/1957 | Nemec | 273/148 |
| 3,871,519 | 3/1975 | Groomes | 206/223 |
| 4,209,085 | 6/1980 | Kozan | 190/51 |
| 4,500,091 | 2/1985 | Rovsek | 273/269 |
| 4,564,091 | 1/1986 | Coneglio | 190/11 |
| 4,646,804 | 3/1987 | Damiano | 150/112 |
| 4,761,008 | 8/1988 | Huggins | 273/148 R |
| 4,948,139 | 8/1990 | Heeszel | 273/148 A |

*Primary Examiner*—Benjamin Layno

[57] ABSTRACT

A bingo caddy useful for transporting and containing bingo player's paraphernalia including a pillow and slanted fold-out multiple playing surfaces with a holding device to hold bingo cards or the like and user friendly placement of marker's etc. The bingo caddy has a unique two section lid or top which folds into a compartmentalized configuration for easy access to all paraphernalia.

18 Claims, 4 Drawing Sheets

BINGO CADDY

This invention relates to carrying cases for games or the like and more particularly to a carrying case for carrying the accessories for the comfort and convenience of playing bingo.

BACKGROUND OF THE INVENTION

Bingo equipment and carrying cases are known in prior art such as taught by U.S. Pat. No. 3,871,519 which discloses two circular carrying cases adapted to carry bingo equipment, or the flexible handbag of U.S. Pat. No. 4,646,804 or the holder for bingo equipment of U.S. Pat. No. 4,761,008. While the above prior art may assist in carrying the equipment to and from a bingo game they do not satisfactorily solve the multiple problems of the bingo player while traveling to and from the game as well as the problems encountered while playing the game of bingo.

The phenomenal increase of participation in the past few years in the game of bingo has created an interest on the part of the present inventors to solve the multiple problems connected with bingo and the present invention addresses the problems of transportation, weight, convenience, organization, playing surface, card holding means, marker availability, etc., which the prior art has not satisfactorily solved.

SUMMARY OF THE INVENTION

It is a primary object therefore, to provide a bingo caddy to carry the equipment necessary for the playing of bingo.

It is a further object to provide a bingo caddy which has provisions for a playing surface which is user friendly and is slanted at an angle which is comfortable and convenient for the player.

Yet another object is to provide in the bingo caddy enough room to store paraphernalia pertinent to playing the game of bingo including a pillow.

Another object is to provide a convenient paper holder for holding objects such as a receipt in plain view for the operators of the game to visually see.

Still another object is to provide hold down means for the bingo cards or sheets which are easily replaceable.

It is a further object to provide slanted surfaces which may be folded out to allow multiple playing surfaces which will conveniently hold a number of bingo cards or sheets.

Still another object is to provide a bingo caddy which organizes all of the paraphernalia including multiple markers, bingo cards, receipts, etc. in an orderly manner.

Another object is to keep all of the paraphernalia within the limited space directly in front of the user and which does not extend into the other players territory on either side or directly across from the player, such as may be encountered at a table.

Another important object is to provide a bingo caddy which may be made of polystrene plastic, wood or pressed wood or the like.

Other objects and advantages will become obvious when taken into consideration with the following drawings and specifications.

DETAILED DESCRIPTION OF THE DRAWINGS

Figure 1:
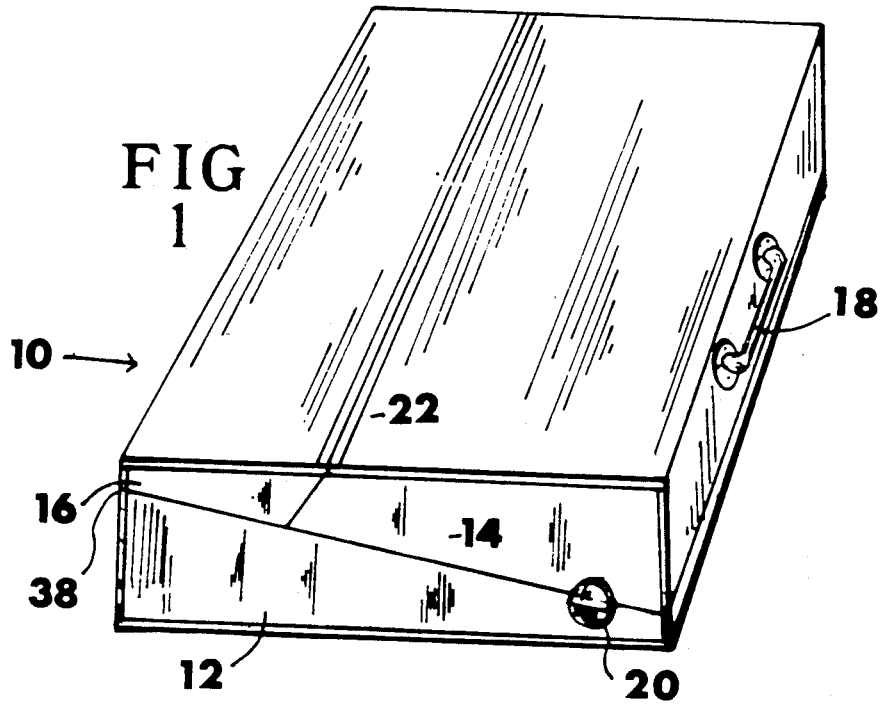
FIG. 1 is a perspective view of the bingo caddy in a closed position.

Referring now to the drawings wherein like reference characters designate like parts shown is a bingo caddy 10 comprising a two part top and a one part bottom.

12 is a bottom part cooperating with the two-section top 14 and 16 respectively, while 18 is a suitable carrying handle and 20 being a means to lock the top 14 to bottom 12, with 22 being a suitable hinge means between top section 16 and top section 14. This hinge means may be made of cloth or tape or even a plastic or metal hinge if so desired, as so may all the hinges used throughout the bingo caddy.

Figure 2:
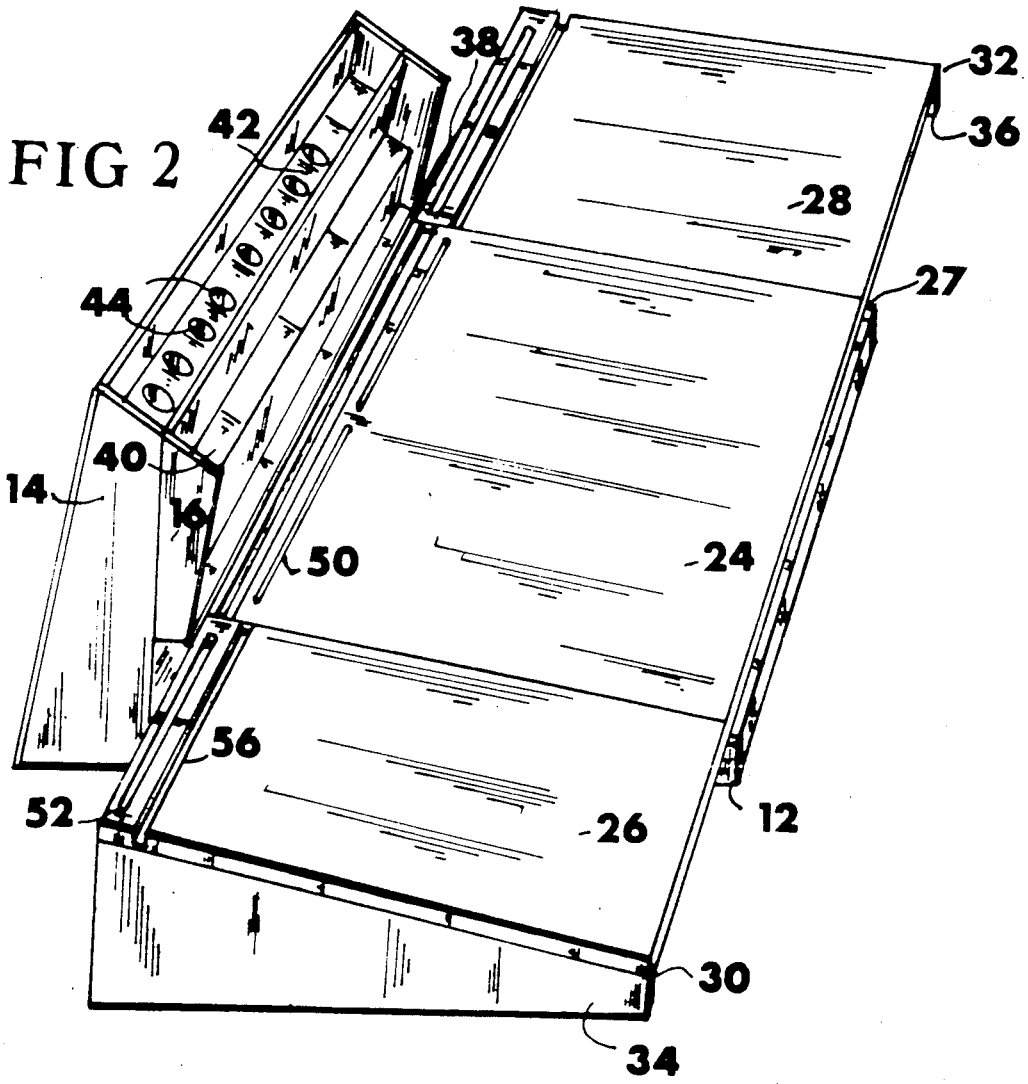
FIG. 2 is a perspective view of the bingo caddy in an open position with the playing surfaces folded out.
Figure 3:
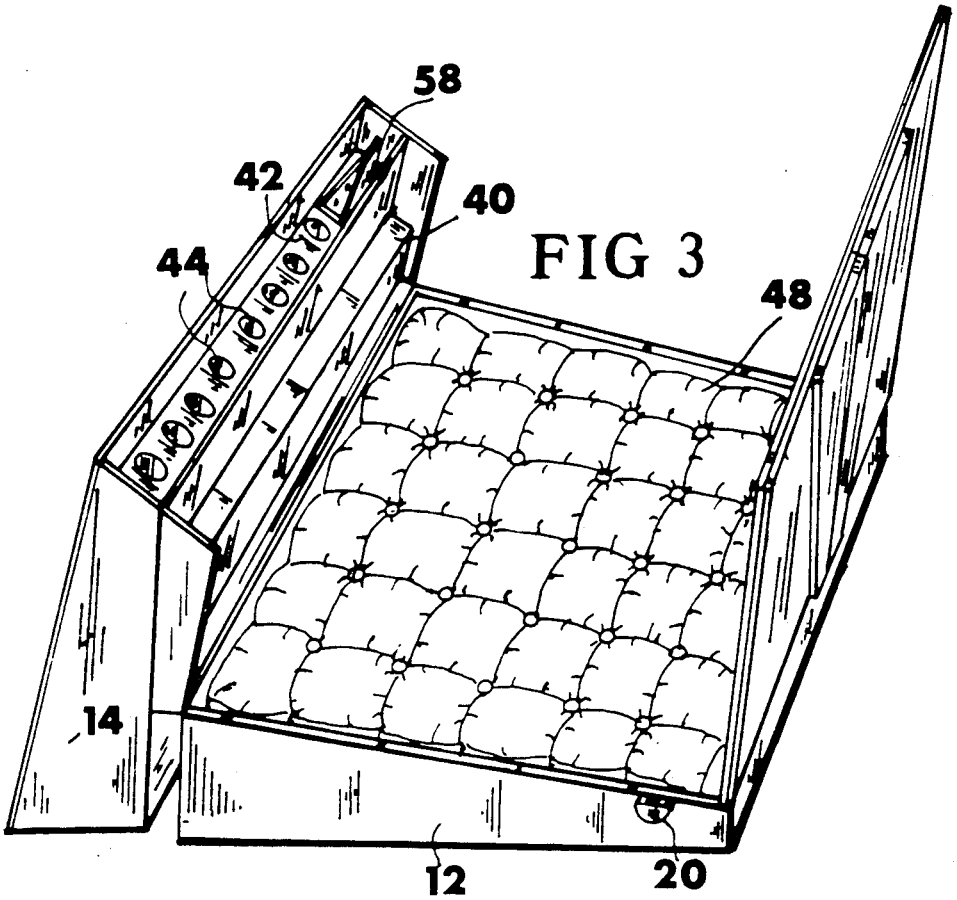
FIG. 3 is a perspective view of the bingo caddy in a semi-open position showing the storage compartment containing a pillow.

In FIG. 2, 24 is a playing surface hinged to bottom 12 at 27 and also hinged to two additional playing surfaces 26 and 28 and also hinged at 30 and 32 to supports 34 and 36 respectively.

Also in FIG. 2, top section 16 is hinged to bottom section 12 at 38 which when the bingo caddy is in an open position exposes interior surfaces 40 and 42 of sections 14 and 16 respectively. Surface 42 may contain multiple wells 44 for holding markers or the like (not shown) while surface 40 may be designed to hold any number of items such as pencils, paper clips, cigarettes, matches etc., (not shown).

Figure 4:
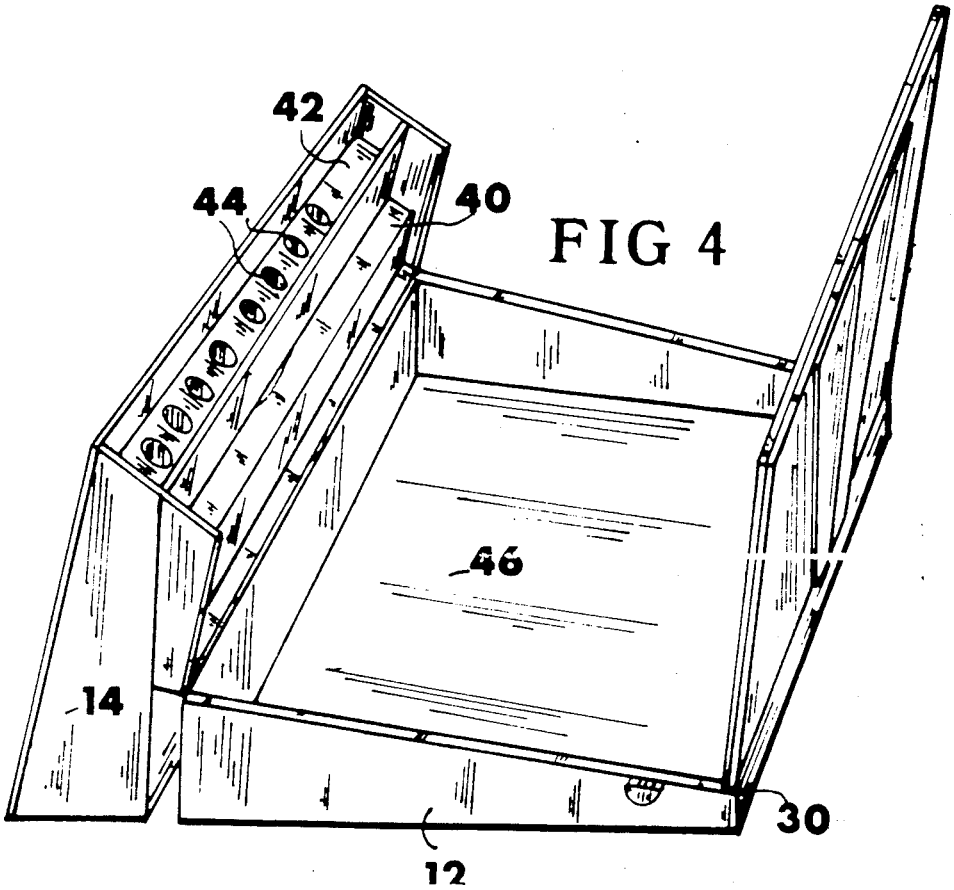
FIG. 4 is a perspective view of the bingo caddy in a semi-open position showing the storage compartment empty.
Figure 5:
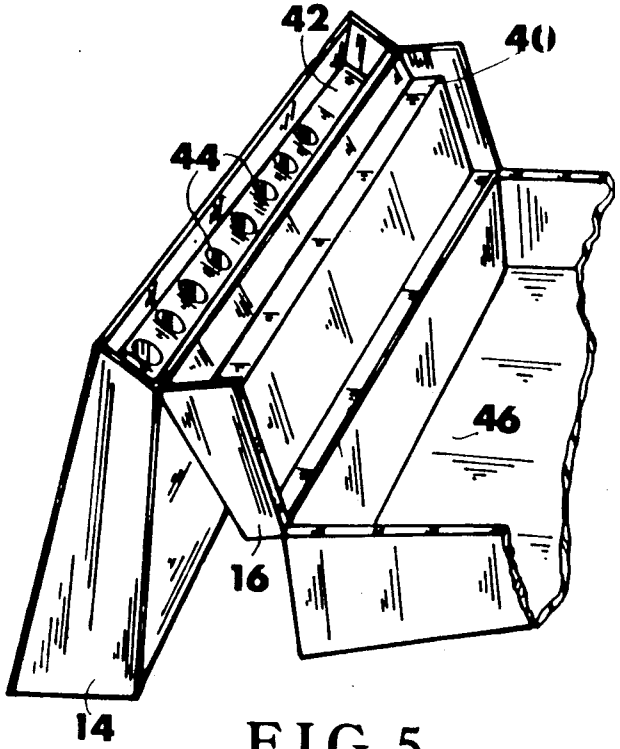
FIG. 5 is a partial perspective view of the bingo caddy showing the lid in a semi-open position.
Figure 6:
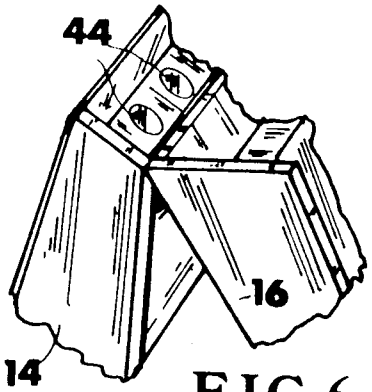
FIG. 6 is a partial perspective view showing at a different scale one of the hinged portions of the lid.
Figure 7:
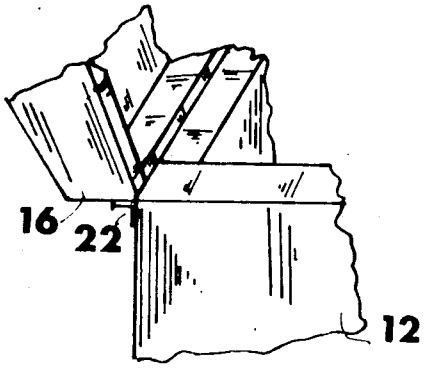
FIG. 7 is a partial perspective view showing at a different scale another of the hinged portions of the lid.
Figure 8:
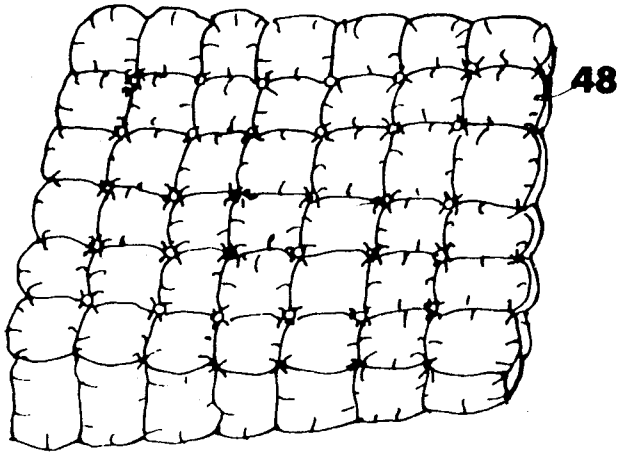
FIG. 8 is a perspective view of a pillow which fits the slanted compartment area.
Figure 10:
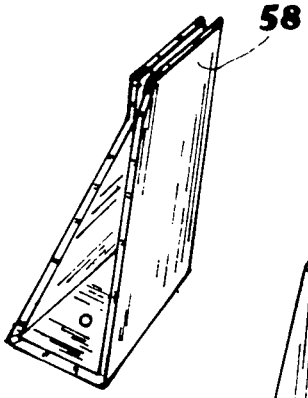
FIG. 10 is a perspective view of a ticket or receipt holder.
Figure 9:
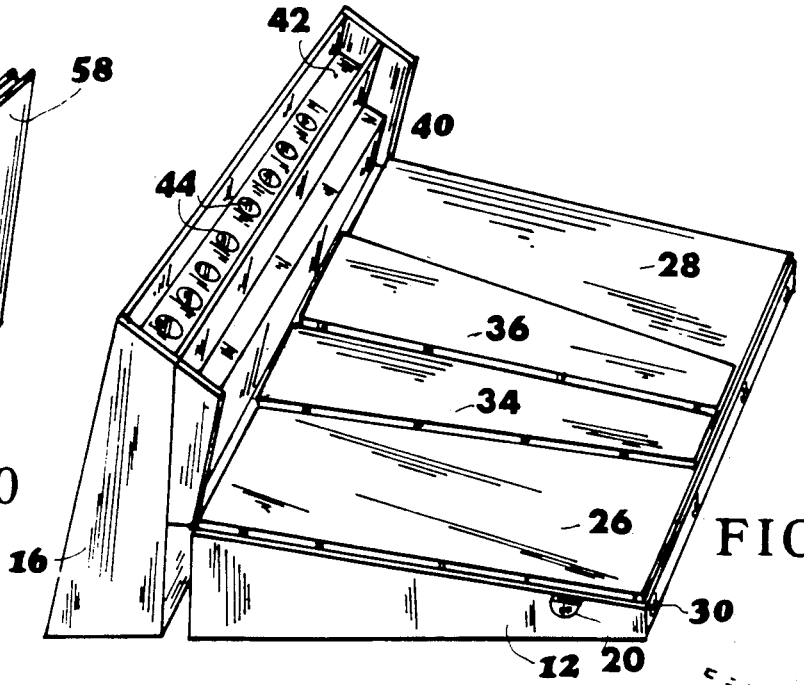
FIG. 9 is a perspective view of the bingo caddy in an open position with the multiple playing surfaces folded into the bingo caddy.
Figure 11:
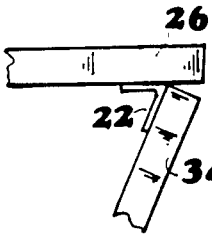
FIG. 11 is a partial perspective view, drawn to a different scale more clearly defining one of the hinged details of the fold-out playing surface.
Figure 12:
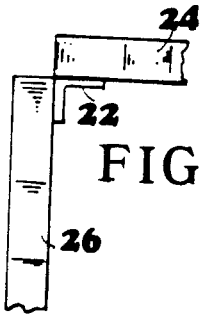
FIG. 12 is a partial perspective view, drawn to a different scale more clearly defining one of the hinged details of the fold-out playing surface.
Figure 13:
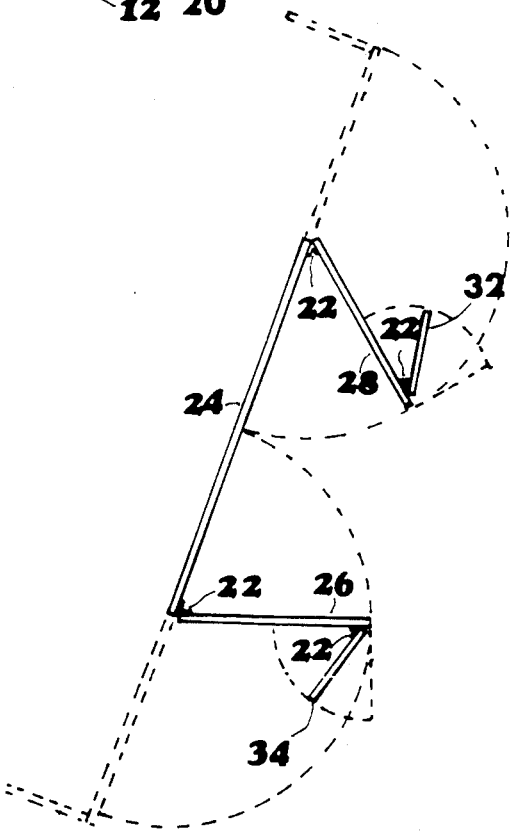
FIG. 13 is a plan view Of the playing surfaces showing them in a partially open position and the ghost lines showing them in a fully extended playing position.
Figure 14:
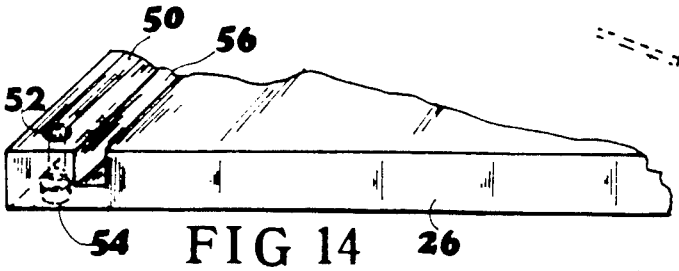
FIG. 14 is a perspective view drawn to a different scale of a preferred card hold-down means on the playing surfaces.

In FIG. 4, 46 is a storage compartment for storing any number of items (not shown) but more specifically a pillow which is shown as reference character 48. In FIGS. 2 and 14 is shown a preferred embodiment of a holding means to hold the bingo cards or papers (to the playing surface) which is a stretchable cord 50 which is installed through multiple holes 52 (only one shown) and kept in place in a taut position by tying a knot in each end of the cord (not shown) which is buried in cavity 54. 56 are elongated slots or cavities cooperating with cords 50 to allow the playing surfaces 24, 26 and 28, respectively to fold in on themselves in a compact manner as the respective cords fit into their respective slots when playing surfaces 24, 26 and 28, respectively, are in their folded position.

58 is a preferred embodiment of a holding device which can be use to hold tickets or receipts or the like so they can be visible to a person located a substantial distance away from the bingo caddy.

It will now be seen that we have provided a bingo caddy 10 which can be utilized as a secure carrying case adapted to maintain the bingo paraphernalia within the various compartments while traveling. Upon reaching the bingo game, the bingo caddy 10 can be simply opened, the cushion removed (and placed on the usually hard chair provided at most bingo games,) the playing sections folded out to their open position and held in a sloped or slanted position by the design and cut of the bottom section and support section. The bingo cards or paper may now be placed on the playing surfaces and held secure by the stretch cords and a receipt for the games placed in the receipt or paper holder.

It will also be noted that the only space taken up by the bingo caddy is directly in front of the player and does not take up more than the player's share of space. All of the markers are plainly displayed and easily accessible by the player as is any other conveniences pertinent to the game of bingo.

Although the invention has been shown and described in what is conceived to be the most practical and preferred embodiment, it is recognized that departures may be make therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by letters patent is:

1. A bingo caddy adapted to be a combined carrying case and a compartmentalized container for holding bingo paraphernalia while resting on a horizontal surface during use in a bingo game, said bingo caddy comprising; a housing including a base and a lid means movably connected to one another and positionable between a first closed and a second open position, both said base and said lid means including a substantially hollow interior, said lid means including a first and second section movably connected to one another and positionable between a first closed and a second open position, said first and second sections of said lid being adapted to receive and hold paraphernalia pertinent to the game of bingo, a panel positioned substantially between said base and said lid, said panel movably connected to said base, said panel having at least one substantially smooth side suitable for use as a writing surface, said writing surface having holding means to hold writing material, said writing surface being of a size to hold at least one bingo game document, whereby, when said lid and said first and second sections of said lid are in said open second positions, said writing surface and said first and second sections of said lid are at an angle to said horizontal surface.

2. The device of claim 1 whereby said bingo paraphernalia includes a pillow, said pillow being of a size and shape to substantially fit into said hollow interior of said base.

3. The device of claim 1 including at least one additional panel movably connected to said panel, said additional panel having a first and second position, said first position allowing said lid when said lid is in its said first closed position to cover said additional panel, said second position allowing said additional panel to extend outside the perimeters of said bingo caddy when said lid is in its said second open position.

4. The device of claim 3 including a support means movably connected to said additional panel at its distal edge, said support means extending substantially from the plane of said panel to said horizontal surface.

5. The device of claim 3 in which said additional panel has means to hold said writing material.

6. The device of claim 5 in which said means to hold said writing material is a tensioned cord.

7. The device of claim 5 in which said panel and said additional panel have elongated cavities cooperating with said tensioned cords to allow said cords to lie in said cavities when said additional panel is in its said first closed position.

8. The device of claim 1 including handle means suitably affixed to said bingo caddy.

9. The device of claim 1 including latching means between said base and said lid.

10. The device of claim 1 in which said first or second sections of said lid contain wells suitable for the storage of bingo markers.

11. The device of claim 1 including means to hold a game receipt visible to a person located a substantial distance away from said bingo caddy.

12. The device of claim 1 in which said means to hold said writing material on said writing surface is a tensioned cord.

13. The device of claim 1 in which said bingo caddy is made of polystyrene plastic.

14. The device of claim 1 in which said bingo caddy is made of wood.

15. The device of claim 1 in which said bingo caddy is made of pressed board.

16. The device of claim 1 in which said base and lid means movably connected to one another is by a cloth tape.

17. The device of claim 1 in which said base and lid means movably connected to one another is by a plastic hinge.

18. The device of claim 1 in which said base and lid means movably connected to one another is by a metal hinge.

* * * * *

UNITED STATES PATENT AND TRADEMARK OFFICE

CERTIFICATE OF CORRECTION

PATENT NO. : 5,054,783

DATED : October 8, 1991

INVENTOR(S) : Hull et al

It is certified that error appears in the above-identified patent and that said Letters Patent is hereby corrected as shown below:

Title page, item [76] Inventors: should read --

Harold L. Hull, 401 Canyon Way, Sp 43, Sparks, Nev. 89434;
Mary K. Rodriguez, 955 Thoma St., Reno, Nev. 89502;
Patricia A. Foster, 166220 Lonehill Dr.,
Morgan Hill, Calif. 95037 --

Signed and Sealed this

Seventh Day of January, 1992

*Attest:*

*Attesting Officer*

HARRY F. MANBECK, JR.

*Commissioner of Patents and Trademarks*